United States Patent [19]

Boucard et al.

[11] Patent Number: 4,989,492

[45] Date of Patent: Feb. 5, 1991

[54] SAFETY DEVICE FOR RELEASABLE AIRBORNE CHARGE

[75] Inventors: Jean Boucard, Boulogne; Jean Deliance; André Winaver, both of Paris, all of France

[73] Assignee: Thomson-Brandt Armements, Boulogne Billancourt, France

[21] Appl. No.: 454,976

[22] Filed: Dec. 22, 1989

[30] Foreign Application Priority Data

Dec. 30, 1988 [FR] France ..... 88 17486

[51] Int. Cl.[5] ..... F42B 25/22; F42C 15/12; F64D 1/06

[52] U.S. Cl. ..... 89/1.55; 89/1.51

[58] Field of Search ..... 89/1.55, 1.51

[56] References Cited

U.S. PATENT DOCUMENTS

| | | | |
|---|---|---|---|
| 3,872,770 | 3/1975 | McGuire | 89/1.55 |
| 3,960,086 | 6/1976 | Fisher | 89/1.55 |
| 4,348,936 | 9/1982 | Fulchiron et al. | 89/1.55 |
| 4,867,035 | 9/1989 | Boucard et al. | 89/1.55 |

FOREIGN PATENT DOCUMENTS

| | | |
|---|---|---|
| 2219056 | 9/1974 | France . |
| 2443663 | 7/1980 | France . |

*Primary Examiner*—David H. Brown

*Attorney, Agent, or Firm*—Oblon, Spivak, McClelland, Maier & Neustadt

[57] ABSTRACT

The disclosure concerns the field of charges releasable from an aircraft to which they are fixed and, particularly, the keel beam safety device that prevents the activation of the charge when it is hooked on beneath the aircraft. A mechanical safety device for the keel beam consists in using the driving force of a sensor that is rotationally free in a support, by means of cable going into said sensor, one end of which is fixed to an aircraft and the other end to means for activating a fuse for the firing of a charge. To this cable, there is fixed a ball which, when a tensile force is exerted on the cable, comes into contact with the sensor and draws it, after the unlocking of the holding system, through a sufficient tensile force exerted on the cable, into contact with the aircraft when the charge is fixed beneath the aircraft, thus preventing any additional movement of the cable. When the charge is released, the cable can be pulled freely and enables the charge to be activated. The disclosure can be applied to bombs where the firing fuse is screwed in along the axis of the bomb, and to all bombs of the MK type.

13 Claims, 5 Drawing Sheets

SAFETY DEVICE FOR RELEASABLE AIRBORNE CHARGE

A. BACKGROUND OF THE INVENTION

1. Field of the Invention

The invention concerns the field of loads or charges releasable from an aircraft to which they are fixed and, in particular, the keel beam safety device which prevents the activating of the charge when it is hooked beneath the aircraft.

2. Description of the Prior Art

Most releasable charges, such as bombs, are fitted out with a number of systems for the control or activation of fuses which have to be activated, after release, at a determined moment on the trajectory of the charge. Permission to activate is provided, in most cases, by a releasable safety device, also called an "RS", formed by a flexible or semi-rigid cable, connected by one of its ends to the aircraft keel beam, that is, to the metallic part fixed to the structure of the aircraft to which the charges are hooked and, by its other end, to the charge to be released or, in certain cases, to the fuse of the bomb.

Any untimely tensile force exerted on this cable, either when it is being positioned beneath the aircraft or during the flight on which the charge is carried beneath the aircraft, for example if it is struck by a winged creature, may cause the unexpected, partial or total activation of the charge that has to be released or of the bomb fuse.

The keel beam safety devices may be either electrical or mechanical. In the latter case, which corresponds to the field of the invention described, the safety device partially or totally prevents the motion of the RS cable when the bomb is hooked beneath the aircraft: these devices, in their application, should enable the following simultaneously:

- hooking the "RS" to any point of the aircraft keel beam;
- operation when the distance between the upper part of the onboard charge and the keel beam of the aircraft is between a few millimiters and a few centimeters;
- preventing the activation of two fuses in one and the same charge.

They should furthermore occupy the most restricted volume possible to avoid adversely affecting:

- the general rigidity of the charge;
- its performance characteristics as a fragment generator;
- the ballistics of the charge if the devices are external.

B. SUMMARY OF THE INVENTION

The object of the invention is an aircraft keel beam safety device for a charge releasable from this keel beam, comprising a cable placed inside a charge in a conduit fixed, firstly, to a support positioned on the periphery of the charge, to which there is fixed a sensor through which there comes out one of the ends of the cable fixed to the aircraft keel beam, this sensor detecting the presence of the aircraft keel beam and thus blocking the exertion of the tensile force on the cable and, secondly, means to activate a fuse for the firing of the charge, said cable being provided with a stop located at a predetermined distance from the sensor to give the sensor a motion of translation restricted by the aircraft keel beam when the charge is placed beneath this keel beam, a device wherein the sensor is rotationally free and locked in the support by a holding system which, under the effect of a sufficient tensile force exerted on the cable and the effect of the stop device of this cable, is unlocked, enabling the activation of at least the means for activating the charge firing fuse after this charge is released, and wherein the device further has means to insert the cable into the sensor, permitting a lateral outgoing of the cable.

C. BRIEF DESCRIPTION OF THE DRAWINGS

The invention will be better understood from the following description, given as a non-restrictive example and illustrated by the appended drawings, of which:

D. DESCRIPTION OF A PREFERRED EMBODIMENT

Figure 1:
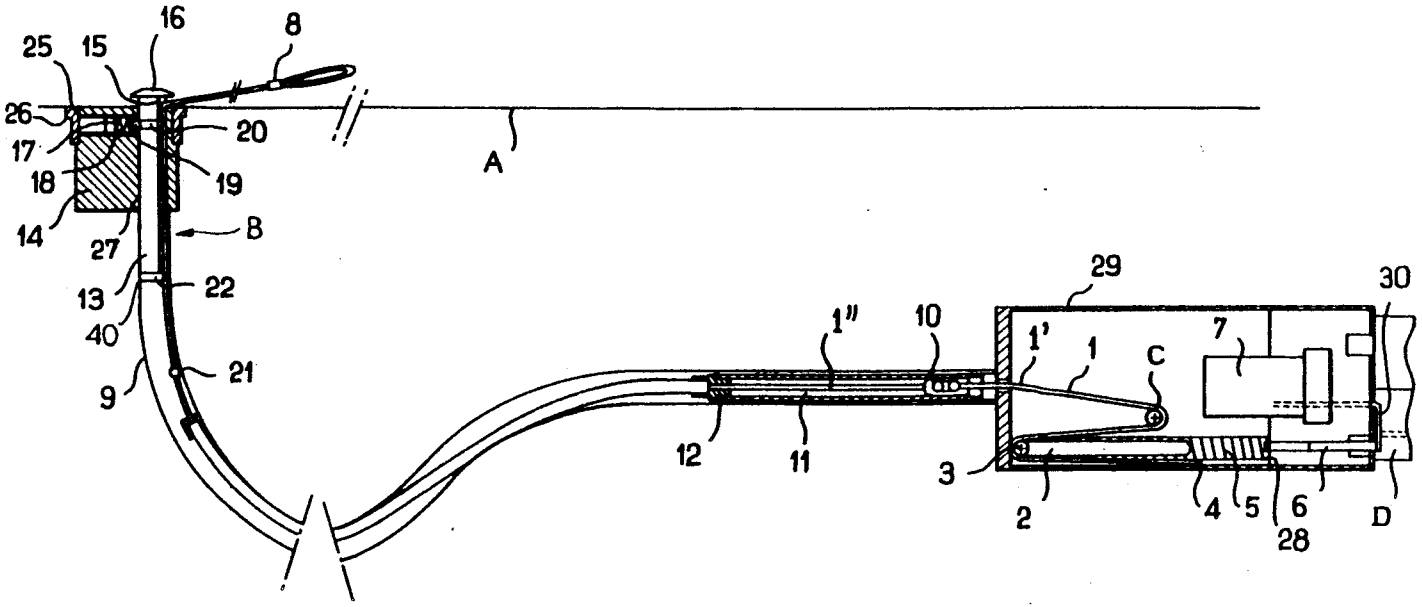
FIG. 1 shows the drawing of a charge fitted out with the device according to the invention after it has been mounted in the charge.

FIG. 1 shows a charge A fitted out with a device generally indicated at B, according to the invention, after this device B has been mounted in the charge and before any handling. This device B is connected by means of a connection cable 1 to a mechanical device C which activates the triggering means D formed, inter alia, by a connection 30 which activates a fuse 7 for the firing of the charge. This mechanical device C is formed, by example, by a rod 2 to which there is fixed a pulley 3, the rim of which receives the cable 1 which has one of its ends connected to a hooking point 4 positioned on the periphery of a tube 29, placed within the charge connected to the device according to the invention by a conduit 9 and containing, inter alia, the mechanical device C and the charge firing fuse 7. When the cable 1 is pulled, the pulley 3 compresses a spring 5 between itself and a stop device 28 placed inside the tube 29, and causes the rod 2 to undergo a movement of translation towards an activating rod 6 until it pushes it by a few centimeters so as to activate the firing fuse 7 by means of the connection 30. According to prior art techniques, this movement was restricted to a travel of 40 mm, and did not allow great freedom of action to the "RS" and to the keel beam sensor. The invention has means to lengthen the travel. These means are formed, for example, by a mechanical system such as a two-pulley system where the travel of the cable is doubled (80 mm). The device B according to the invention has the connection cable 1 having one of its ends 8 designed to be fixed beneath an aircraft (not shown). The fixing beneath this aircraft can be done at different places in adding, for example, at the end 8, a lengthening cable enabling a determined hooking point to be reached. This connection cable 1 is positioned inside a conduit 9, the dimensions of which have been calculated with respect to the location of the different modules forming the charge A as well as the system for hooking the "RS", namely the cable 1, beneath the aircraft. This cable 1 provides for the connection with the triggering means D. This cable 1 is separated into two parts 1' and 1'', connected to each other by an element 10 that can slide inside a tube 11, placed in the conduit 9 facing the tube 29, up to an end 12 of the tube 11. This flexible or semi-rigid cable, for example a multiple-strand, stainless steel cable, goes into a sensor 13 placed in a support or threaded cap 14, fixed with respect to an external ring 26 that prevents any motion of the support 14 and is located on the periphery of the charge A. A hole 27, enabling the sensor 13 to go into the support 14, is in a position facing the hole of the conduit 9. The sensor 13 is, for example, a hollow cylinder wherein, on its periphery, a vertical slot 15 has been machined, enabling the cable 1 to be inserted into the hollow cylinder. The upper end of this sensor 13 is shut by a head 16 that does not allow the cable to go out by this upper end but on a lateral surface. Furthermore, this sensor 13 is left so as to be free in rotation within the support 14 to make it easier to hook the cable 1 beneath the aircraft. It is held in its initial position by means of a holding system 25, for example a system comprising a spring 18, pushing a valve 17 against a ball 19 housed in a groove 20 made on the periphery of the sensor so that the ball 19 of the holding system 25 leans on this groove 20 and holds the sensor 13 in the position shown when no tensile force is exerted on the cable 1. For, the cable 1 is provided with a stop device, for example a ball 21, located at a determined distance from another stop device fixed to the lower end of the sensor so that, when a tensile force is exerted on the cable, the ball 21 comes into contact with the lower end of the sensor thus drawing the sensor 13 along after the unlocking of the holding system 25 due to the tensile force. The stop device is formed, for example, by an element 22 that gets screwed into the lower end of the sensor. This element 22 has, for example, a hollow 40 at its center as seen in FIG. 1, enabling the centering of the cable, and a slot on its periphery, enabling the cable to be inserted into its center. The position of the ball 1 enables the translation motion of the sensor under the effect of a certain degree of tensile force and, when this sensor is positioned beneath the aircraft, it strikes the aircraft keel beam and thus prevents the cable from being tensed, that is, it prevents the activation means from being triggered.

Figure 2:
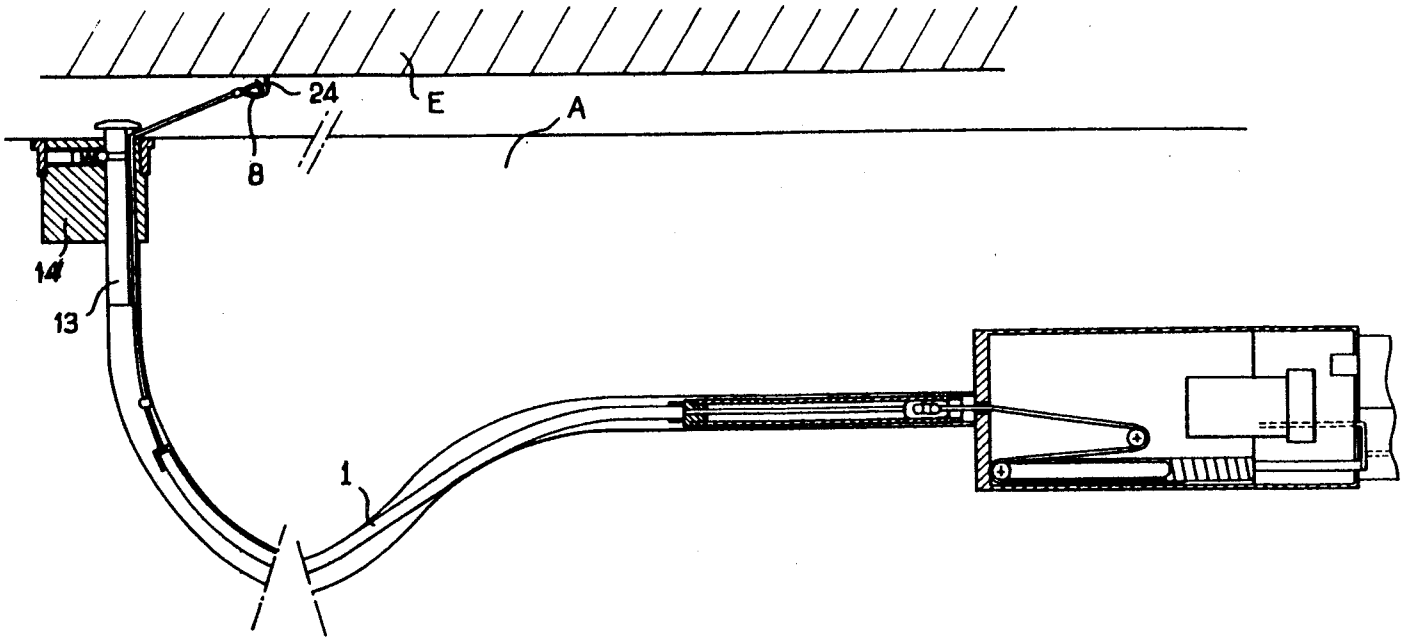
FIG. 2 shows the drawing of a charge fitted out with the device according to the invention, after it has been hooked beneath an aircraft.
Figure 3:
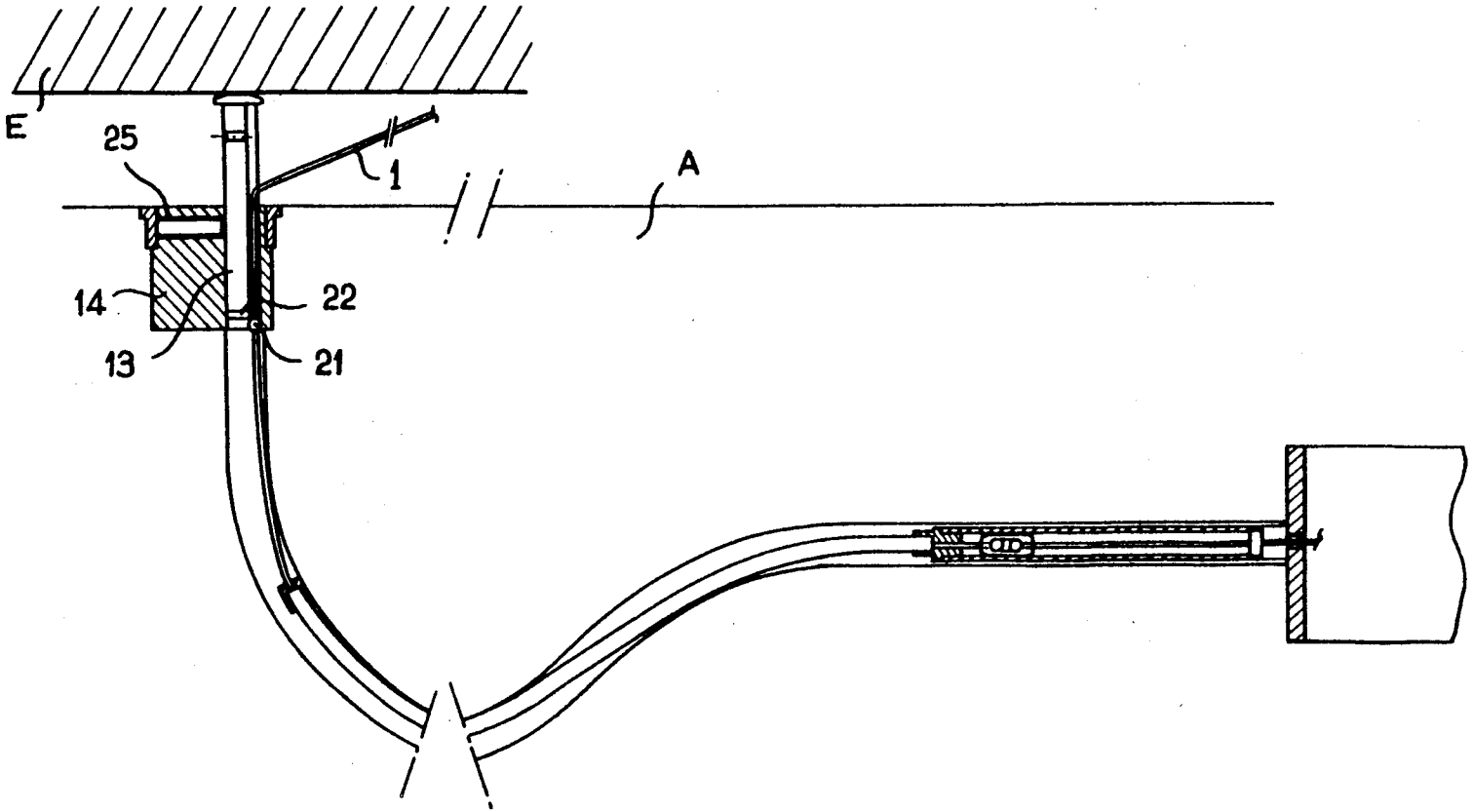
FIG. 3 shows the drawing of a charge fitted out with a device according to the invention, after the stretching of a cable before the release of the charge.
Figure 4:
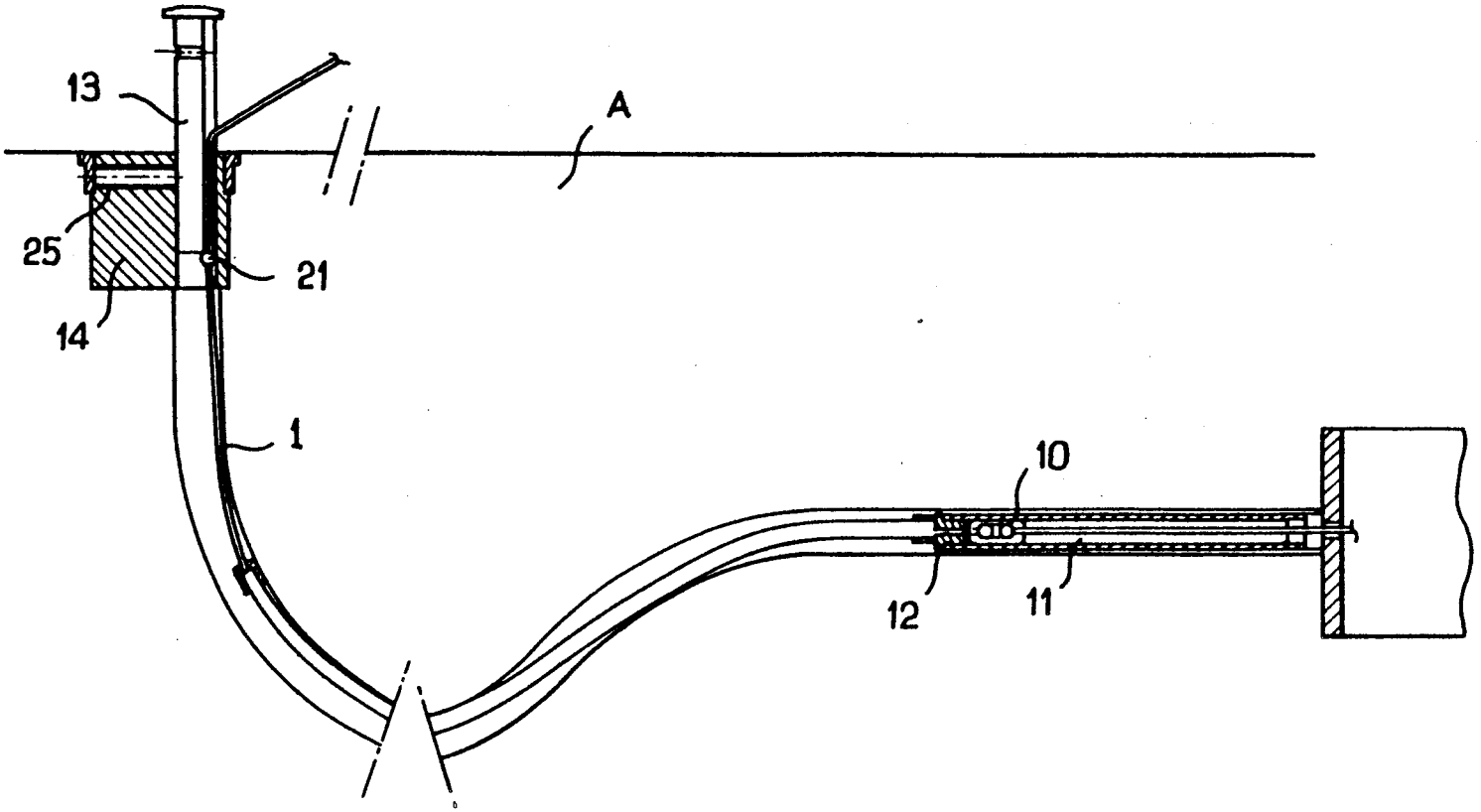
FIG. 4 shows the drawing of a charge fitted out with the device according to the invention, after the charge has been released from the aircraft.

FIGS. 2, 3 and 4 represent the different stages of operation of the device when it is placed beneath an aircraft. FIG. 2 shows the charge A fitted out with the device B according to the invention after it has been hooked beneath an aircraft E. The hooking ring 8 is hooked beneath the aircraft E at a place 24 fixed by the conditions under which the aircraft is built and assembled. This place 24 is at any distance from the outlet of the safety cable 1. At this instant, no element of the device undergoes any stress, and the charge therefore remains inactive.

FIG. 3 shows the charge A fitted out with the device according to the invention, after the stretching of the "RS" before the charge A is released. A tensile force is exerted on the cable 1, the ball 21 fixed to this cable 1 leans on the element 22 fixed to the end of the sensor 13, and it draws this sensor along, after the unlocking of the holding system 25 due to sufficient tension on the cable 1, in a vertical motion of translation. Since the charge is placed beneath the aircraft E, the sensor 13, after travelling for a few centimeters, strikes the aircraft and thus prevents any activation of the means D for triggering the charge firing fuse.

FIG. 4 shows the charge fitted out with the device according to the invention after the stretching of the "RS" and after it has been released from the aircraft. In the first stage, following the instant of release, the ball 21 positioned on the cable 1 comes into contact with the sensor 13 and draws it along under the effect of the tensile force, thus unblocking the holding system 25. The element 10 slides longitudinally inside the tube 11 under the effect of this tensile force. Since the sensor is no longer limited, in its travel, by the aircraft, it enables the element 10 to come to a stop against the end 12. The connecting cable 1, connected to mechanical device C, which is not shown but is described with reference to FIG. 1, has then travelled the sufficient distance enabling the activation of the means D for triggering the charge A. With the firing fuse being activated and the other safety devices having been withdrawn, the charge A can function.

Figure 5:
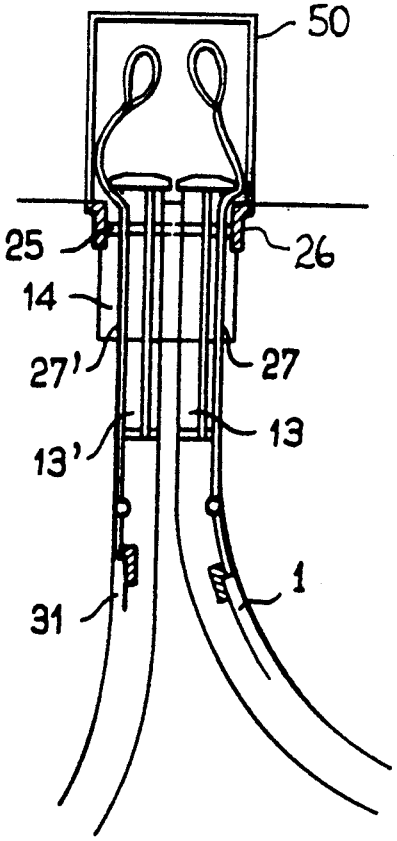
FIG. 5 shows the drawing of a charge provided with two devices according to the invention.

To prevent infiltration into the system described, an imperviousness capsule 50 may be fixed, for example, to the element 26 fixing the support 14 as shown in FIG. 5. This capsule 50 is very useful when storing charges A in an unsheltered place.

In the exemplary embodiment described, only one sensor has been used and positioned within its charge A but, for particular applications, for example when the charge comprises a nose fuse and a base fuse, it is possible to envisage the making of a support provided with two sensors fitted out with the same device according to the invention, as shown in FIG. 5. This device thus enables the activation of two fuses, not shown in the drawing of FIG. 5. To do this, the support 14 has two holes 27 and 27', within which two sensors 13 and 13' according to the invention are placed. The holding system 25 works according to the same principle as that of the invention, that is, it is unlocked when sufficient tensile force is exerted on the cables 1 and 31. Moreover, it enables a reduction in bulk.

The system according to the invention can be applied more particularly to axial channel bombs, namely bombs for which the firing fuse is screwed in along the axis of the bomb. For, in certain bombs, for example all bombs of the MK type, the device according to the invention meets every safety and manufacturing requirement for its use. This device can be made in different dimensions, notably depending on the space available in the charge, but also depending on the different elements forming the invention. For example the size of the sensor may vary according to the distance from the aircraft keel beam to the onboard charge.

We claim:

1. An aircraft keel beam safety device for a charge releasable from this keel beam, comprising a cable placed inside a charge in a conduit fixed, firstly, to a support positioned on a periphery of the charge, to which there is fixed a sensor through which there comes out a first end of the cable fixed to the aircraft keel beam, this sensor detecting the presence of the aircraft keel beam by contact when, after a pulling of the cable, the sensor is translated and thus inhibiting the exertion of the tensile force on the cable and, secondly, means to activate a fuse for the firing of the charge, wherein the sensor is rotationally free and locked into the support by a holding system which, under the effect of sufficient tensile force exerted in the cable provided with a stop located at a determined distance from the sensor to give the sensor a motion of translation restricted by the aircraft keel beam when the charge is placed beneath this keel beam, is unlocked, enabling an activation of at least the means to activate the fuse for firing the charge, after this charge is released, and wherein the device further has means to insert the cable into the sensor, permitting a lateral exit of the cable.

2. A keel beam safety device according to claim 1, wherein the sensor has a groove enabling an insertion of the cable into the sensor.

3. A keel beam safety device according to claim 1, wherein the sensor has an element at its lower end, enabling the stop of the cable to come to a stop against the sensor and to then draw it along.

4. A keel beam safety device according to claim 1, wherein the support has at least one hole, enabling a passage of the sensor positioned so as to be facing at least one conduit.

5. A keel beam safety device according to claim 1, wherein the holding system has a spring pushing a valve against a ball housed in a groove, thus inhibiting any translational motion of the sensor when no tensile force is exerted on the cable.

6. A keel beam safety device according to claim 1, wherein the support is fixed with respect to an external ring that prevents any movement of the support.

7. A keel beam safety device according to claim 6, wherein the external ring supports an imperviousness capsule closing the support.

8. A keel beam safety device according to claim 1, wherein a mechanical system comprises means for lengthening a travel of the cable, triggering the activation means D.

9. A keel beam safety device according to claim 8, wherein the lengthening means are constituted by a mechanical system with double pulley.

10. A keel beam safety device according to claim 1, wherein the cable is flexible or semi-rigid.

11. A keel beam safety device according to claim 1, wherein the cable has a first part and a second part, connected by a connecting element placed within a tube.

12. A keel beam safety device according to claim 11, wherein the connecting element slides longitudinally under an action of the cable, inside the tube, up to an end of this tube, providing for the triggering of the means to activate the fuse of the charge.

13. A bomb with a charge and an activating system including an aircraft keel beam safety device, said safety device comprising: a cable placed inside the charge in a conduit fixed, firstly to a support positioned on a periphery of the charge, to which there is fixed a sensor through which there comes out a first end of the cable fixed to the aircraft keel beam, this sensor detecting the presence of the aircraft keel beam by contact when, after a pilling of the cable, the sensor is translated and thus inhibiting the exertion of the tensile force on the cable and, secondly, means to activate a fuse for the firing of the charge, wherein the sensor is rotationally free and locked into the support by a holding system which, under the effect of sufficient tensile force exerted in the cable provided with a stop located at a determined distance from the sensor to give the sensor a motion of translation restricted by the aircraft keel beam when the charge is placed beneath this keel beam, is unlocked, enabling an activation of at least the means to activate the fuse for firing the charge, after this charge is released, and wherein the device further has means to insert the cable into the sensor, permitting a lateral exit of the cable.

* * * * *